US009491999B2

(12) United States Patent
Watanabe et al.

(10) Patent No.: US 9,491,999 B2
(45) Date of Patent: Nov. 15, 2016

(54) MIST GENERATOR DEVICE

(71) Applicant: PANASONIC CORPORATION, Osaka (JP)

(72) Inventors: Shunichi Watanabe, Shiga (JP); Kazuya Oguri, Shiga (JP); Mitsuru Fujiwara, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 288 days.

(21) Appl. No.: 14/287,777

(22) Filed: May 27, 2014

(65) Prior Publication Data

US 2014/0361104 A1 Dec. 11, 2014

(30) Foreign Application Priority Data

Jun. 11, 2013 (JP) ..... 2013-122889

(51) Int. Cl.
*A62C 31/02* (2006.01)
*B05B 1/00* (2006.01)
(Continued)

(52) U.S. Cl.
CPC ..... *A45D 34/00* (2013.01); *A61H 33/12* (2013.01); *A61H 33/6021* (2013.01); *B05B 1/00* (2013.01); *A61H 2201/0107* (2013.01); *A61H 2201/0176* (2013.01); *A61H 2201/0235* (2013.01); *B05B 7/0012* (2013.01)

(58) Field of Classification Search
CPC .. A45D 34/00; A61H 33/12; A61H 33/6021; A61H 2201/0107; A61H 2201/0176; A61H 2201/0235; B05B 1/00; B05B 7/0012
USPC ..... 239/589, 690, 699, 102.1, 102.2
See application file for complete search history.

(56) References Cited

U.S. PATENT DOCUMENTS 6,543,701 B1 * 4/2003 Ho ..... B05B 17/0615 128/200.16
7,775,459 B2 * 8/2010 Martens, III ..... B05B 17/0684 128/200.14

(Continued)

FOREIGN PATENT DOCUMENTS

CN 1302573 A 7/2001
EP 2119422 A1 11/2009

(Continued)

OTHER PUBLICATIONS

Chinese Office Action and Search Report issued in Chinese Application No. 201410226949.3 dated Feb. 1, 2016, with English Translation of Search Report.

(Continued)

*Primary Examiner* — Justin Jonaitis
(74) *Attorney, Agent, or Firm* — McDermott Will & Emery LLP

(57) ABSTRACT

A mist generator device includes a mist generation unit that generates mist from a liquid. A mist flow passage is connected to the mist generation unit. The mist from the mist generation unit flows through the mist flow passage. A tubular mist nozzle releases the mist, which is supplied from the mist generation through the mist flow passage, out of the mist generator device. The mist nozzle includes a mist entrance, a mist exit, and an inner constriction located at an inner side of the mist nozzle. The inner constriction includes a step that decreases an inner diameter of the mist nozzle from the mist entrance toward the mist exit.

5 Claims, 9 Drawing Sheets

(51) Int. Cl.

| | |
|---|---|
| ***F23D 11/38*** | (2006.01) |
| ***A45D 34/00*** | (2006.01) |
| ***A61H 33/12*** | (2006.01) |
| ***A61H 33/00*** | (2006.01) |
| *B05B 7/00* | (2006.01) |

(56) References Cited

U.S. PATENT DOCUMENTS

| | | | | |
|---|---|---|---|---|
| 2009/0065600 | A1* | 3/2009 | Tranchant | A45D 34/02 239/4 |
| 2009/0134235 | A1* | 5/2009 | Ivri | B05B 17/0646 239/4 |
| 2009/0200398 | A1* | 8/2009 | Duru | B05B 17/0623 239/102.2 |

FOREIGN PATENT DOCUMENTS

| | | | |
|---|---|---|---|
| JP | H02-92364 | A | 4/1990 |
| JP | 11-004869 | A | 1/1999 |
| JP | 2001-190632 | A | 7/2001 |
| JP | 2008-079733 | A | 4/2008 |
| JP | 2010-253059 | A | 11/2010 |
| JP | 2012-130553 | A | 7/2012 |
| JP | 5005306 | B2 | 8/2012 |

OTHER PUBLICATIONS

Extended European Search Report issued in corresponding European Application No. 14169771.4, dated Nov. 25, 2014.

Japanese Office Action issued in Japanese Application No. 2013-122889 dated May 17, 2016.

* cited by examiner

MIST GENERATOR DEVICE

CROSS-REFERENCE TO RELATED APPLICATIONS

This application is based upon and claims the benefit of priority from prior Japanese Patent Application No. 2013-122889, filed on Jun. 11, 2013, the entire contents of which are incorporated herein by reference.

BACKGROUND ART

The present invention relates to a mist generator device that generates mist from a liquid and releases the generated mist.

A mist generator device generates mist from a liquid and releases the generated mist toward a user to moisturize the skin of the user for beauty and skin care purposes.

The mist generator device includes a mist generation unit, which is accommodated in a housing, a flow passage, which is connected to the mist generation unit, and a mist nozzle, which is arranged on the upper surface of the housing. The mist generator device generates mist from liquid with the mist generation unit and releases the generated mist through the mist passage.

The mist nozzle has a smaller inner diameter than the mist passage. This increases the velocity of the mist flowing through the mist nozzle and allows the mist to reach a farther position (refer to, for example, Japanese Laid-Open Patent Publication No. 2012-130553).

The mist nozzle may include an inner surface that functions to hold water in pits or pores. When mist condenses into liquid on the inner surface of the mist nozzle, the inner surface, or water holding portion, holds the condensed liquid. This allows mist to be stably released from the mist generator device without being hindered by the condensed liquid (refer to, for example, Japanese Laid-Open Patent Publication No. 11-4869).

The mist velocity may be increased by reducing the inner diameter of the mist nozzle, which serves as the outlet for the mist, from the inner diameter of the mist passage. However, the mist condenses into liquid droplets in the mist nozzle. The liquid droplets partially or completely block the mist passage and change the cross-sectional area of the flow passage. This may destabilize the release of the mist due to, for example, a decrease in the released mist amount, a change in the mist velocity, and a change in the releasing direction of the mist.

Accordingly, the mist generator device of Japanese Laid-Open Patent Publication No. 11-4869 uses a porous material to form the inner surface of the material. This allows liquid droplets to be absorbed by the porous material in the mist nozzle while decreasing the inner diameter of the mist nozzle and increasing the velocity of the mist. As a result, liquid droplets do not block the mist passage in the mist nozzle. This stabilizes the mist release.

However, when the porous material in the mist nozzle is saturated with the absorbed liquid, the porous material cannot hold more liquid. In such a case, liquid droplets cannot be absorbed by the porous material and remain in the mist nozzle. Consequently, in the same manner as described above, the liquid droplets block the mist passage and destabilize the mist release. Thus, there is still room for improvement to the mist generator device.

It is an object of the present invention to provide a mist generator device that releases mist with further stability.

One aspect of the present invention is a mist generator device including a mist generation unit that generates mist from a liquid. A mist flow passage is connected to the mist generation unit. The mist from the mist generation unit flows through the mist flow passage. A tubular mist nozzle releases the mist, which is supplied from the mist generation through the mist flow passage, out of the mist generator device. The mist nozzle includes a mist entrance, a mist exit, and at least one inner constriction located at an inner side of the mist nozzle. The at least one inner constriction includes a step that decreases an inner diameter of the mist nozzle from the mist entrance toward the mist exit.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

Figure 1:
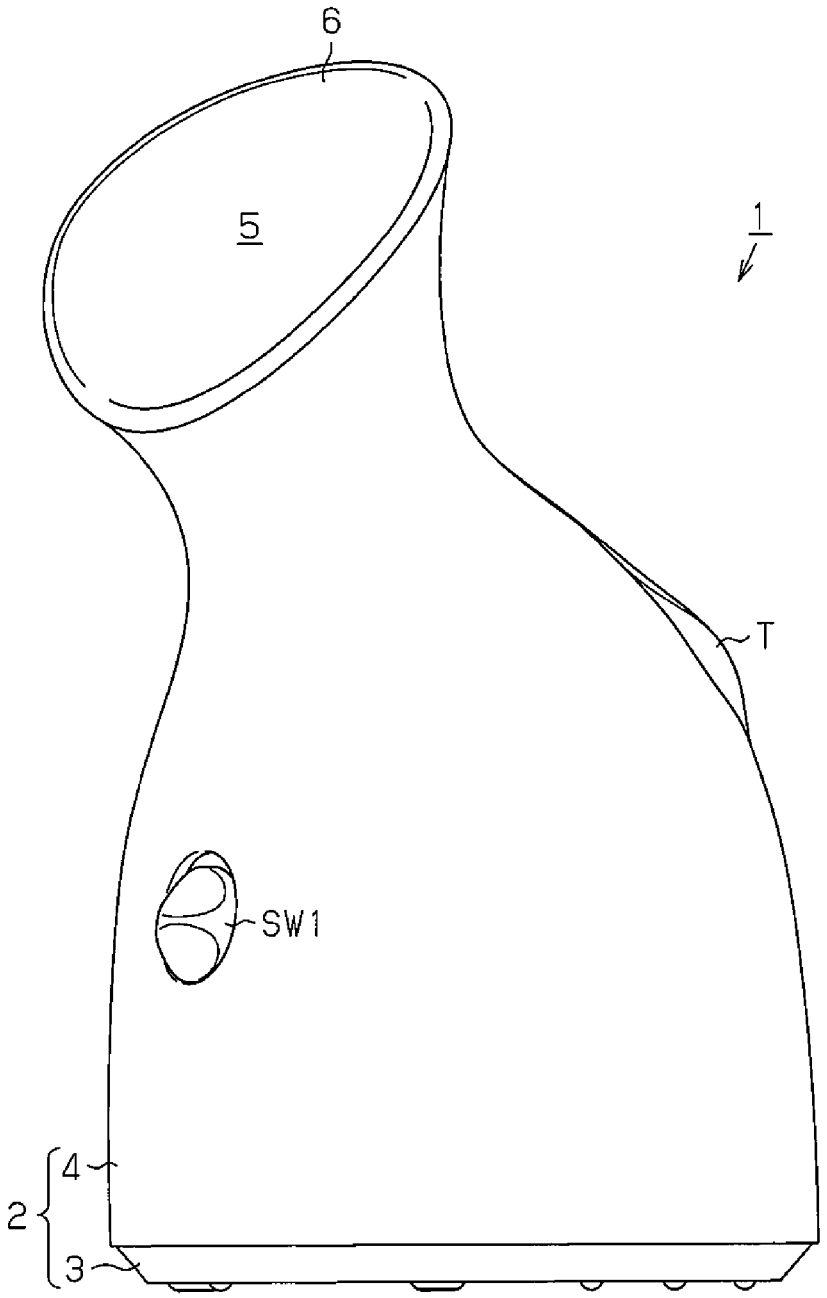
FIG. 1 is a perspective view showing one embodiment of the mist generator device from a front side.

One embodiment of the present invention is a mist generator device including a mist generation unit that generates mist from a liquid. A mist flow passage is connected to the mist generation unit. The mist from the mist generation unit flows through the mist flow passage. A tubular mist nozzle releases the mist, which is supplied from the mist generation through the mist flow passage, out of the mist generator device. The mist nozzle includes a mist entrance, a mist exit, and at least one inner constriction located at an inner side of the mist nozzle. The at least one inner constriction includes a step that decreases an inner diameter of the mist nozzle from the mist entrance toward the mist exit.

In the mist generator device, the mist nozzle includes a first inner surface located closer to the mist entrance than the step of the at least one inner constriction, and a second inner surface located closer to the mist exit than the step of the at least one inner constriction. The first inner surface is shorter in an axial direction of the mist nozzle than the second inner surface.

Further, the mist nozzle includes at least one outer constriction located at an outer side of the mist nozzle. The at least one outer constriction includes a step that decrease an outer diameter of the mist nozzle from the mist entrance to the mist exit.

The at least one inner constriction includes an inner corner located at an inner end of the step in a radial direction of the mist nozzle. The inner corner is rounded or chamfered.

The mist entrance includes a rounded or chamfered corner.

A cosmetic device according to one embodiment of the present invention will now be described with reference to the drawings. The present invention is not limited to this embodiment.

Referring to FIGS. 1 to 5, a cosmetic device 1, which functions as a mist generator device, includes a case 2 formed by a bottom plate 3 and a housing 4. The bottom plate 3 may be elliptical and have a major axis that extends in the longitudinal direction of the case 2. Further, the bottom plate 3 may be formed from plastic. The bottom plate 3 includes a bonding piece formed around the rim of the bottom plate 3. The housing 4 is coupled to the bonding piece of the bottom plate 3 and extends toward the upper side from the bottom plate 3. The housing 4 may be formed from plastic. Various components used to generate mist are accommodated in a cavity S formed between the bottom plate 3 and the housing 4 in the case 2.

The housing 4 is narrowed toward the upper side. The housing 4 includes a distal end that forms an opening 5 facing the front and extending diagonally in the upper direction. A mist passage cover 6 is fitted to the opening 5. The mist generated in the housing 4 is released from the mist passage cover 6 toward the front and diagonally in the upper direction.

A power switch SW1 is arranged in a front section of the housing 4. A power plug PL is arranged in a left rearward section of the housing 4.

Figure 2:
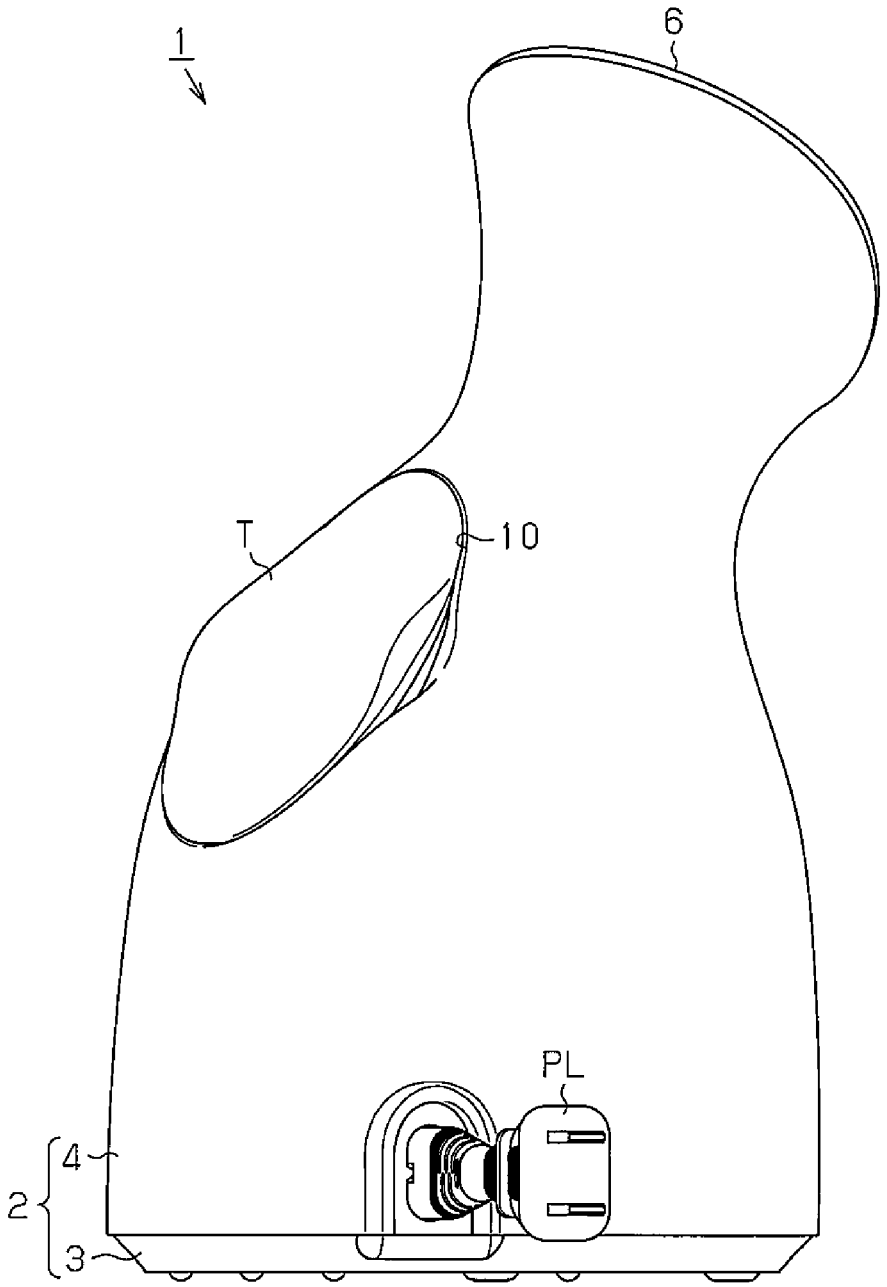
FIG. 2 is a perspective view showing the mist generator device from a rear side.
Figure 4:
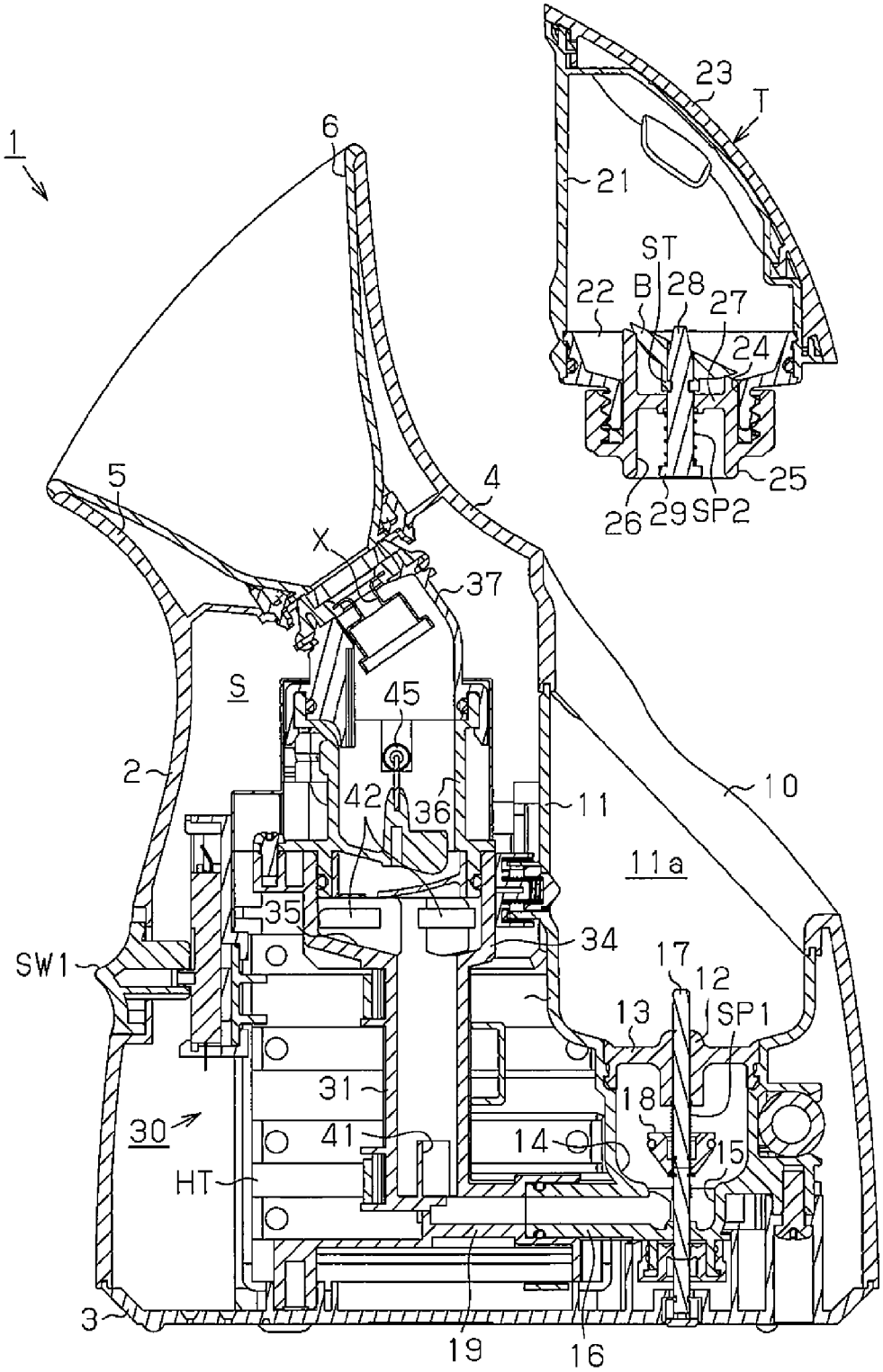
FIG. 4 is a cross-sectional side view showing the mist generator device with the liquid tank removed from the mist generator device.

As shown in FIGS. 2 and 4, an opening 10 is formed in the rear surface of the housing 4. A plastic tank holder 11 that extends toward the bottom plate 3 is arranged in the cavity S below the opening 10.

Figure 3:
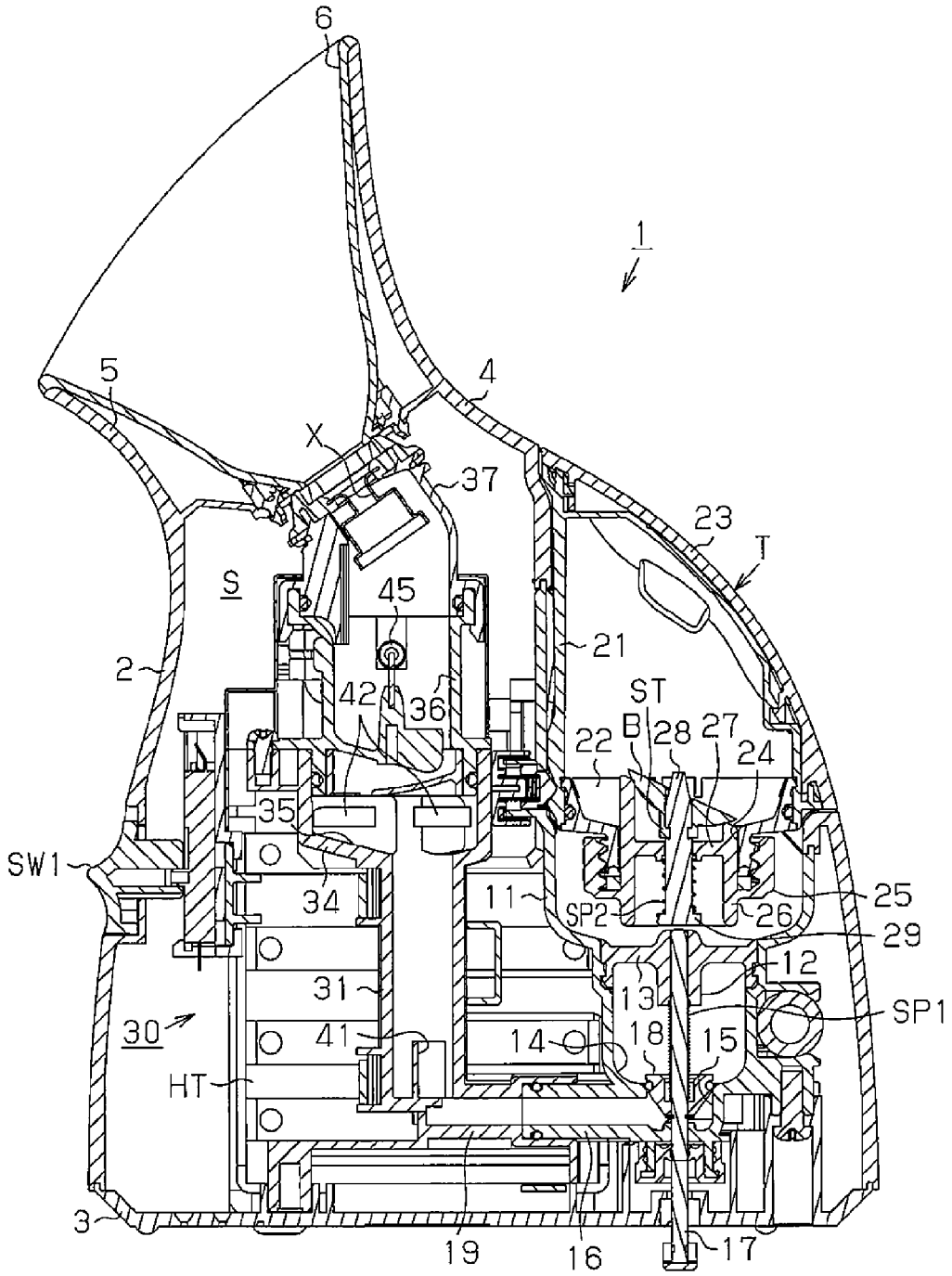
FIG. 3 is a cross-sectional side view showing a liquid tank of the mist generator device.

The tank holder 11 includes a lower portion supported by the bottom plate 3 and an upper portion fixed to the housing 4. The tank holder 11 includes a tank compartment 11*a* facing the opening 10. As shown in FIGS. 3 and 4, a liquid tank T is set in the tank compartment 11*a* in a removable manner.

A bearing sleeve 12 is arranged in the tank compartment 11*a*. When the liquid tank T is accommodated in the tank compartment 11*a*, the bearing sleeve 12 is located at a position corresponding to the bottom middle section of the liquid tank T. Ribs 13 extend from the outer surface of the bearing sleeve 12. The ribs 13 extend in the longitudinal direction and a direction orthogonal to the longitudinal direction in a cross-shaped arrangement. The ribs 13 are connected to the tank holder 11 and located in correspondence with the bottom middle section of the liquid tank T.

The tank holder 11 includes a bottom portion 14. An outgoing port 15 extends through the bottom portion 14 at a position corresponding to the bottom middle section of the liquid tank T. A supply pipe 16 is connected to the outgoing port 15. The supply pipe 16 is formed integrally with the outgoing port 15 and extends toward the front side of the cosmetic device 1.

A disconnection rod 17 extends through the bottom plate 3, the supply pipe 16, and the outgoing port 15. The disconnection rod 17 includes a distal portion supported in the bearing sleeve 12 to be movable in the axial direction.

When the cosmetic device 1 is lifted and the bottom plate 3 is free, that is, when the cosmetic device is not set on a table or the like (refer to FIG. 3), the basal end of the disconnection rod 17 projects from the bottom plate 3. Under this situation, the distal end of the disconnection rod 17 is flush with the upper open end of the bearing sleeve 12.

When the cosmetic device 1 is set on a table or the like (refer to FIG. 4), the disconnection rod 17 is pushed and moved toward the upper side. Thus, the distal end of the disconnection rod 17 projects from the upper open end of the bearing sleeve 12.

The outgoing port 15 extending through the bottom portion 14 of the tank holder 11 may receive a valve 18, which is fixed to the disconnection rod 17 that extends through the outgoing port 15. A spring SP1 is arranged on the disconnection rod 17 between the valve 18 and the bearing sleeve 12. The spring SP1 applies a downward elastic force to the disconnection rod 17.

Accordingly, when the cosmetic device 1 is set on a table or the like, the disconnection rod 17 moves toward the upper side against the elastic force of the spring SP1. When the cosmetic device 1 is lifted and not set on a table or the like, the elastic force of the spring SP1 moves the disconnection rod 17 toward the lower side. This projects the basal end of the disconnection rod 17 from the bottom plate 3.

Referring to FIG. 4, when the cosmetic device 1 is set on a table or the like and the disconnection rod 17 is pushed and lifted, the valve 18 is moved toward the upper side. This opens the outgoing port 15 and connects the tank compartment 11*a* (liquid tank T) to the supply pipe 16.

Referring to FIG. 3, when the bottom plate 3 is free and the disconnection rod 17 projects toward the lower side from the bottom plate 3, the valve 18 is lowered. This closes the outgoing port 15 and disconnects the tank compartment 11*a* from the supply pipe 16.

The liquid tank T arranged in the tank compartment 11*a* of the tank holder 11 includes a reservoir 21 and a cap 22. The reservoir 21 includes an open lower portion that is fitted to the tank compartment 11*a* of the tank holder 11. The cap 22 closes the open lower portion. The reservoir 21 includes a rear outer surface defining an outer wall 23 in the rear side of the housing 4 to cover the opening 10. The outer wall 23 of the reservoir 21 is continuous with the outer wall of the housing 4.

The cap 22 includes a cylindrical neck 24 that extends toward the lower side from the central position of the cap 22. A male threaded portion is formed on the outer surface of the neck 24. A valve member 25 is fastened to the neck 24.

As shown in FIGS. 3 and 4, the valve member 25 includes a cylinder 26. A female threaded portion formed in the outer wall of the cylinder 26 is engaged with the male threaded portion of the neck 24. This connects the cylinder 26 to the neck 24.

The cylinder 26 includes a partially open (not shown) support wall 27. An operation rod 28 is inserted through the support wall 27 and movable in the axial direction. A stopper ST is attached to the operation rod 28 above the support wall 27 so that the operation rod 28 does not fall off the support wall 27.

The operation rod 28 includes a lower end forming an engagement projection 29. A spring SP2 is arranged between the engagement projection 29 and the support wall 27. The spring SP2 applies a downward elastic force to the operation rod 28.

Referring to FIG. 4, when the cosmetic device 1 is set on a table or the like and the disconnection rod 17 is moved toward the upper side, the disconnection rod 17 contacts the lower surface of the operation rod 28 and moves the operation rod 28 to the upper side against the elastic force of the spring SP2. A valve body B is attached to the operation rod 28 at the distal side of the stopper ST.

When the operation rod 28 is moved to the upper position, the valve body B opens the opening (not shown) in the support wall 27. Under this situation, the valve 18 opens the outgoing port 15 in the bottom portion 14 of the tank holder 11. Thus, liquid in the liquid tank T is delivered through the outgoing port 15 in the bottom portion 14 of the tank holder 11 to the supply pipe 16.

The liquid tank T is removed from the tank compartment 11*a* of the housing 4. The valve member 25 is then removed from the neck 24, and liquid is filled into the liquid tank T from the neck 24. After filling the liquid, the valve member 25 is fastened to the neck 24. Then, the liquid tank T is set in the tank compartment 11*a* of the housing 4.

As shown in FIG. 4, when the liquid tank T is removed from the cosmetic device 1, the valve B closes the opening in the support wall 27. Thus, water does not flow out of the liquid tank T.

The water delivered to the supply pipe 16 from the liquid tank T is sent to the mist generation unit 30, which includes a mist generation body 31. The mist generation body 31, which may be formed from plastic, includes a lower portion that is formed integrally with a liquid feed pipe 19, which is connected to the supply pipe 16. The mist generation body 31, which is supported by the bottom plate 3, extends toward the upper side.

Figure 5:
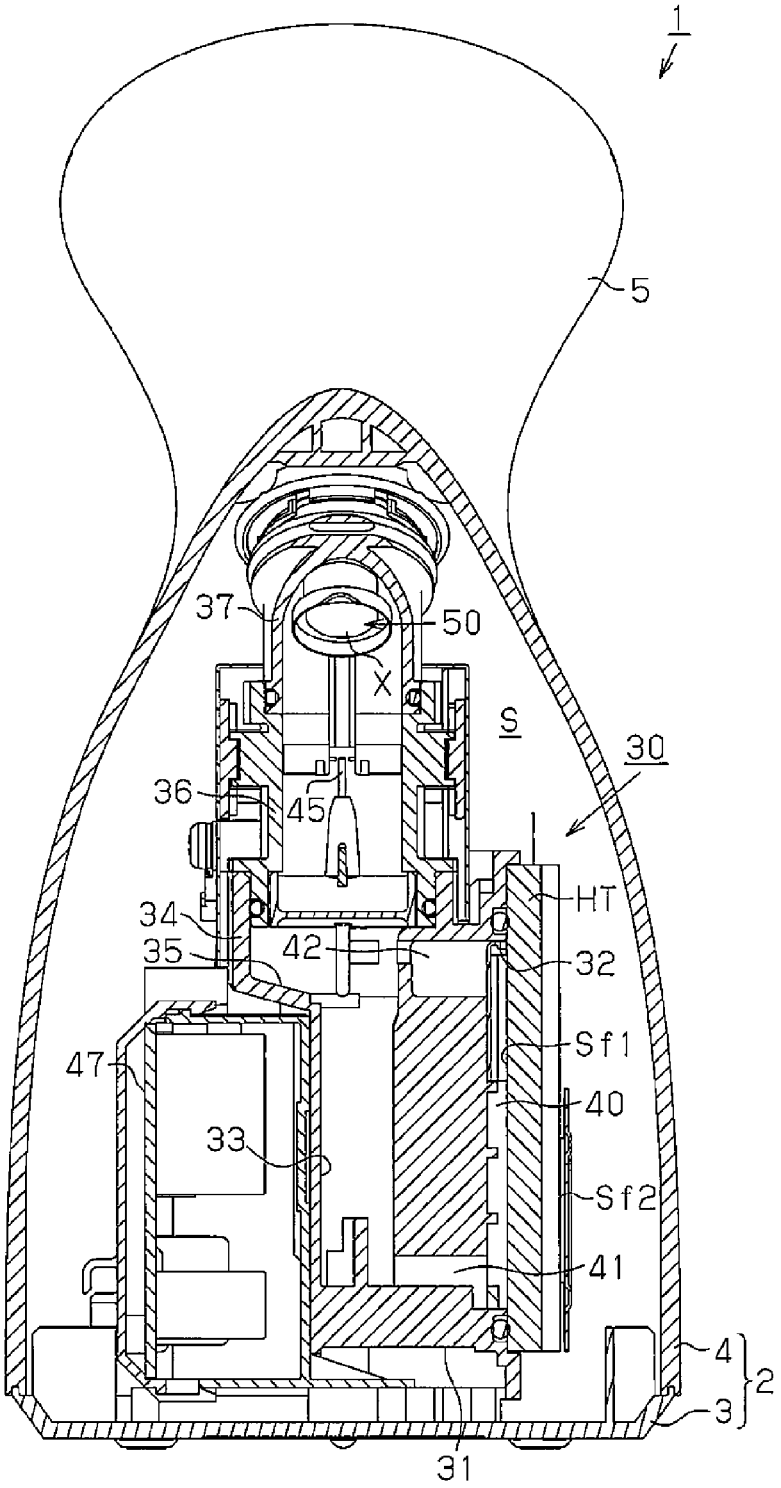
FIG. 5 is a cross-sectional rear view showing the mist generator device in a mist generation and release mode.

As shown in FIG. 5, the mist generation body 31 includes an opening recess 32, which is recessed toward the right. A left portion of the mist generation body 31 includes a liquid return passage 33 that extends in the vertical direction. The lower side of the liquid return passage 33 is connected by a lower passage 41 to the liquid feed pipe 19 show in FIG. 3.

The upper side of the liquid return passage 33 is enlarged to form a large diameter portion 34, which is connected to a mist guide tube 36. The liquid return passage 33 is connected to a sloped step surface 35 of the large diameter portion 34. The large diameter portion 34 receives the water condensed on a mist guide tube 36, which is located above the large diameter portion 34, or a mist flow pipe 37, which is located above the mist guide tube 36 the mist flow, is received by the large diameter portion 34 and guided along the sloped step surface 35 of the large diameter portion 34 into the liquid return passage 33.

The condensed water drawn into the liquid return passage 33 is returned from a lower passage 41 to a boiling chamber 40 or the liquid feed pipe 19.

A heater HT closes the opening recess 32 of the mist generation body 31. The boiling chamber 40 extends in the vertical direction between the heater HT, which closes the opening recess 32, and the mist generation body 31.

The heater HT is, for example, a PTC heater accommodated in the aluminum case. The heater HT includes an inner surface Sf1 (surface facing the boiling chamber 40) that is opposed to the mist generation body 31. The lower passage 41, which extends toward the left through the lower portion of the mist generation body 31, connects the liquid return passage 33 and the liquid feed pipe 19 (not shown in FIG. 5) at the lower portion of the boiling chamber 40.

Accordingly, the liquid delivered from the liquid tank T to the supply pipe 16 is supplied through the liquid feed pipe 19 and the lower passage 41 to the boiling chamber 40. The heater HT heats and boils the liquid supplied to the boiling chamber 40 to generate steam, or warm mist, in the boiling chamber 40.

An upper passage 42, which extends toward the right through the upper portion of the mist generation body 31, connects the upper portion of the boiling chamber 40 to the large diameter portion 34 at the upper side of the liquid return passage 33. The upper passage 42 supplies the mist generated in the boiling chamber 40 to the large diameter portion 34.

As shown in FIGS. 3 to 6, the upper portion of the large diameter portion 34 is connected to the mist guide tube 36. The mist guide tube 36 may be formed from plastic. The large diameter portion 34 and the upper passage 42 connect the mist guide tube 36 to the boiling chamber 40. The warm mist generated in the boiling chamber 40 is drawn into the mist guide tube 36. A high-voltage discharge device 45 is arranged in the mist guide tube 36.

The high-voltage discharge device 45 performs a high-voltage discharge to ionize and atomize the steam drawn into the mist guide tube 36 and generate atomized warm mist. The mist flow pipe 37, which is located above the high-voltage discharge device 45 and which is formed from plastic or the like, guides the warm mist to a mist nozzle 50. The warm mist is then released from the cosmetic device 1 through the opening 5 (mist passage cover 6) toward the front in a diagonally upper direction.

Referring to FIG. 5, a control circuit board 47 is attached to the mist generation body 31 at the opposite side of the heater HT. The control circuit board 47 is connected to wires (not shown) extending from the power switch SW1, the power plug PL, and the heater HT. The power switch SW1, the power plug PL, and the heater HT are connected in series on the control circuit board 47.

When the power switch SW1 is turned on, the control circuit board 47 generates operation power for the heater HT from the power supplied by the power plug PL and supplies the operation power to the heater HT. A wire (not shown) extending from the high-voltage discharge device 45 is also connected to the control circuit board 47. The control circuit board 47 is configured to generate and supply operational power used to perform discharging.

Figure 6:
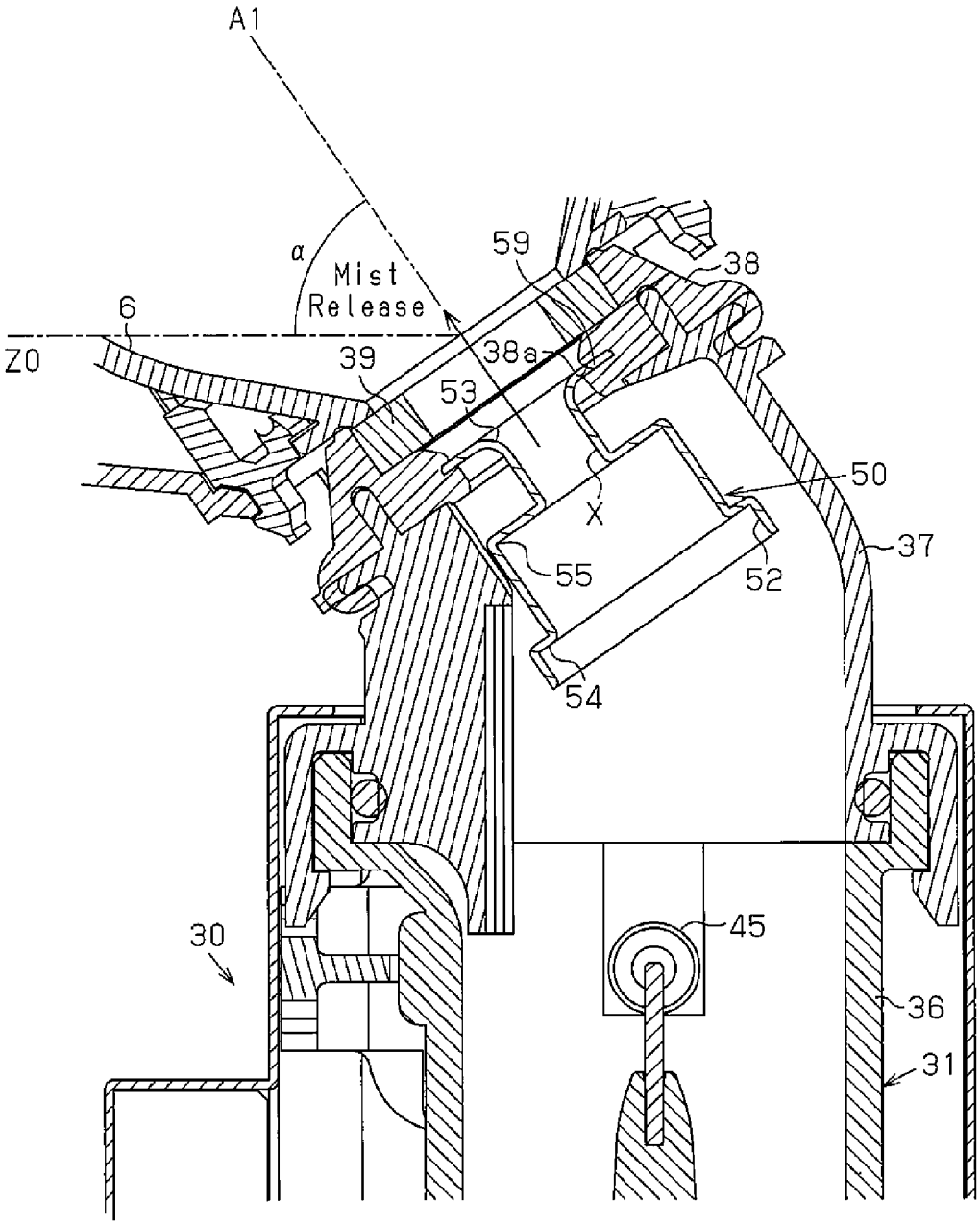
FIG. 6 is a partial, enlarged cross-sectional view showing a mist nozzle of the mist generator device.

As shown in FIG. 6, the mist nozzle 50 is coupled to the inner rim of an annular coupling member 38, which is coupled to a distal portion of the mist flow pipe 37. The pressure of the warm mist is increased in the mist flow pipe 37, and the mist nozzle 50 releases the warm mist from the cosmetic device 1. The mist nozzle 50 is formed from a metal having high heat conductance such as aluminum.

Figure 7:
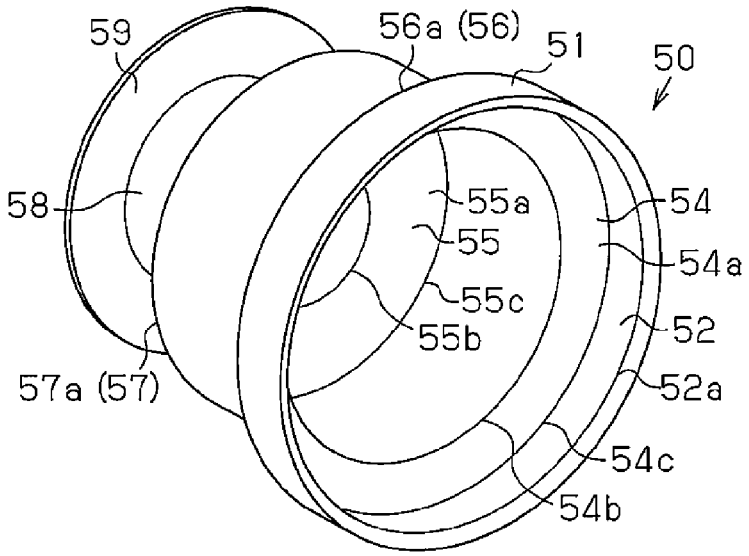
FIG. 7 is a perspective view showing the mist nozzle of the mist generator device.
Figure 8:
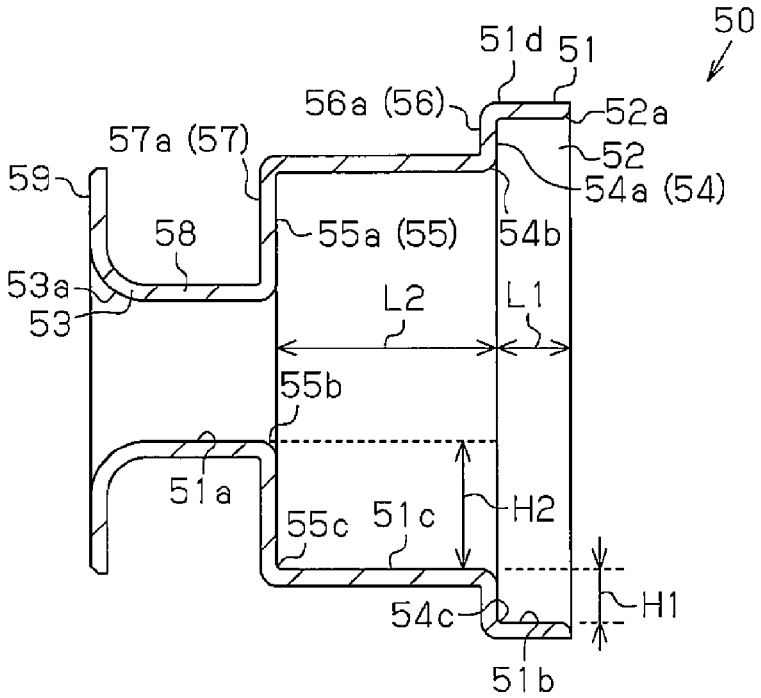
FIG. 8 is a cross-sectional view showing the mist nozzle of the mist generator device.

Referring to FIGS. 6 to 8, the mist nozzle 50 includes a tube 51 and a flange 59 extending from the outer surface of the tube 51. The inner side of the tube 51 forms a nozzle passage X through which the warm mist flows when released from the cosmetic device 1.

When the mist nozzle 50 shown in FIG. 6 is coupled to the cosmetic device 1, mist is released in the direction extending along the axis A1 of the tube 51, that is, the direction in which the nozzle flow passage X extends. The mist releasing direction is inclined upward by a predetermined angle $\alpha$ from a reference plane Z0 (generally horizontal plane) that is parallel to the plane on which the cosmetic device 1 is set.

The tube 51 includes a mist entrance 52, a mist exit 53, two inner constrictions 54 and 55, and two outer constrictions 56 and 57. The nozzle flow passage X connects the mist entrance 52, which is located at one end of the tube 51, and the mist exit 53, which is located at the other end of the tube 51. This allows for mist to flow into and out of the tube 51.

As shown in FIGS. 7 and 8, the two inner constrictions 54 and 55 are formed on the inner surface 51*a* of the tube 51 so that the inner diameter of the tube 51 decreases from the upstream mist entrance 52 to the downstream mist exit 53. The inner constriction 54 includes a step 54*a*, an inner corner 54*b*, and an outer corner 54*c*. The inner constriction 55 includes a step 55*a*, an inner corner 55*b*, and an outer corner 55*c*.

The inner constriction 54 is formed at one end of the tube 51, or a position located closer to the mist entrance 52 than the inner constriction 55. The step 54*a* of the inner constriction 54 decreases the inner diameter of the tube 51 to the inner diameter of the inner nozzle surface 51*c* having a smaller inner diameter than the mist entrance 52 of the tube 51.

Further, the step 55*a* of the inner constriction 55 decreases the inner diameter of the tube 51 to form a minimum diameter portion 58 having a smaller inner diameter than the inner nozzle surface 51*c*. The step 54*a* of the constriction 54 has a height (radial length) H1, and the step 55*a* of the inner constriction 55 has a height (radial length) H2, which is greater than the height H1.

An inner nozzle surface 51*b* extending from the inner constriction 54 to the mist entrance 52 has an axial length L1, and an inner nozzle surface 51*c* extending from the inner constriction 55 to the inner constriction 54 has an axial length L2. The mist nozzle 50 is formed to satisfy L1>H1 and L2>H2.

Figure 9:
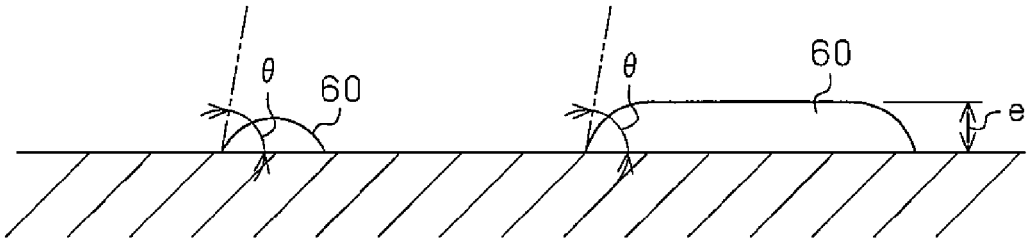
FIG. 9 is a schematic diagram showing the growth and height of the condensed liquid.

Referring to FIG. 9, an increase in the diameter of a liquid droplet 60 would result in gravitational force acting on and flattening the liquid droplet 60 so that the liquid droplet 60 has height e. The relationship of the height e of the liquid droplet 60, the contact angle θ, the surface tension γ of the liquid, the density ρ of the liquid, and the gravitational acceleration g is known to satisfy the following equation.

$$e = 2\sqrt{\frac{\gamma}{\rho g}}\sin\frac{\theta}{2} \qquad \text{Equation 1}$$

It is preferable that the height e of a liquid droplet with a contact angle θ on a plane having the same roughness as the inner surface 51*a* in the tube 51 of the mist nozzle 50 be measured and the heights H1 and H2 of the two steps 54*a* and 55*a* be formed to obtain a height that is greater than or equal to the height e.

In such a structure, even when the liquid droplet 60 grows, the liquid droplet 60 would not grow to a height allowing the liquid droplet 60 to move beyond a step. This limits the entrance of liquid droplets into the next constriction or the minimum diameter portion 58. In the present embodiment, the heights H1 and H2 of the two steps 54*a* and 55*a* are set to be two times greater than the height e of a liquid droplet.

The tube 51 of the mist nozzle 50 includes an outer surface 51*d* including two outer constrictions 56 and 57 formed by steps decreasing the outer diameter of the mist nozzle 50 (tube 51) from the mist entrance 52 to the mist exit 53. The outer constrictions 56 and 57 include steps located at substantially the same positions as the corresponding inner constrictions 54 and 55 in the axial direction of the tube 51 and having substantially the same heights as the corresponding inner constrictions 54 and 55.

The flange 59 extends toward the outer side in the radial direction from the outer surface of the mist exit 53 of the tube 51. The mist exit 53 includes a corner 53*a* that is smoothly rounded to the flange 59.

As shown in FIG. 6, the flange 59 is formed at the exit end of the nozzle flow passage X and extends toward the outer side in the radial direction from the outer surface of the mist nozzle 50. The flange 59 is held in a coupling groove 38*a* extending along the inner surface of the coupling member 38. Thus, even when the pressure in the mist flow pipe 37 increases, warm mist is released only from the minimum diameter portion 58.

The operation of the cosmetic device 1 in the present embodiment will now be described.

In the cosmetic device 1, when the power switch SW is pushed, the heater HT is driven. When the heater HT is driven, liquid (water) is heated and boiled in the boiling chamber 40. This generates steam in the boiling chamber 40. The steam is atomized into warm mist by the high-voltage discharge device 45. Then, the warm mist is guided to the mist nozzle 50 and released from the opening 5.

The mist nozzle 50 is formed from a metal having high heat conductance such as aluminum. Thus, when the warm mist passes through the nozzle flow passage X and the mist nozzle 50 receives heat energy from the warm mist, the temperature of the tube 51 quickly rises to the same temperature as the warm mist. This limits condensation at the minimum diameter portion 58.

When warm mist is generated and water vapor is in a saturated state, water easily condenses on the inner surface 51*a* in the tube 51 of the mist nozzle 50. Liquid droplets 60 on the inner surface 51*a* of the mist nozzle 50 has a tendency of collecting at the two outer corners 54*c* and 55*c* due to the flow of the warm mist.

The liquid droplets 60 grow and gradually increase in size at each of the outer corners 54*c* and 55*c*. However, the liquid droplets 60 do not move beyond the steps 54*a* and 55*a* of the constrictions 54 and 55 and spread in the axial direction. When a certain amount of liquid droplets 60 collects, the gravitational force acting on the liquid droplets, or the weight of the liquid droplets, overcomes surface tension, and the liquid droplets 60 move toward the mist entrance 52 (upstream side) of the mist nozzle 50 (tube 51).

Here, each liquid droplet 60 joins with other liquid droplets on the steps 54*a* and 55*a* and is further increased in size. As a result, the liquid droplet 60 falls from the mist entrance 52 of the mist nozzle 50 (tube 51).

Since such actions are repeated, even though warm mist continuously strikes, collects, and condenses on the inner surface of the mist nozzle 50, the condensation does not exceed a certain amount. This limits the entrance of the liquid droplets 60 into the minimum diameter portion 58.

Further, the mist entrance 52 has a larger inner diameter than the mist exit 53. Thus, the cross-sectional area of the flow passage at the mist entrance 52 is larger than that at the minimum diameter portion 58. As a result, the velocity of the warm mist at the mist entrance 52 is lower than that at the mist exit 53. This decreases the force of the warm mist that acts to push the liquid droplets 60. That is, the force that overcomes gravitational force acting on the liquid droplets 60 is limited.

Further, liquid droplets on the outer surface of the mist nozzle 50 collect, grow, and gradually increase in size on the steps 56*a* and 57*a* of the outer constrictions 56 and 57. The liquid droplets then become large enough to fall due to gravitational force and then move to the next step. Thus, small liquid droplets do not enter the nozzle inlet and flow toward the minimum diameter portion 58 on the inner nozzle surface when warm mist flows.

Further, the mist nozzle 50 is entirely reduced in thickness. This decreases the heat capacity at the mist nozzle 50 and raises the temperature of the inner surface further quickly. In particular, the temperature rising speed may be increased at the minimum diameter portion 58.

Thus, thus even when the cosmetic device 1 starts to operate and the temperature of the cosmetic device 1 is still low, the temperature of the mist nozzle 50 becomes the same as the warm mist from immediately after the warm mist is generated. This limits condensation. Further, the mist entrance 52 is rounded. This reduces surface tension at the mist entrance 52 so that liquid droplets easily fall at the entrance. That is, liquid droplets easily fall from the mist nozzle 50.

The mist exit 53 is also rounded like the mist entrance 52. Thus, even when small condensation occurs on the inner surface of the minimum diameter portion 58 in the mist nozzle 50 when the cosmetic device 1 starts to operate under a low-temperature environment, the condensation may be discharged from the minimum diameter portion 58 to the exit. Accordingly, before condensation flows toward the exit and grows at the downstream end due to surface tension, the condensation may be discharged toward the exit from the minimum diameter portion 58, that is, from the region where the pressure and the mist velocity are high.

A liquid absorbent 39 such as felt may be arranged at the exit of the mist nozzle 50 so that the discharge liquid droplets do not return to the minimum diameter portion 58.

Further, when the cosmetic device 1 is set, the mist entrance 52 of the tube 51 is directed toward the lower side (refer to FIG. 6). Thus, gravitational force acts on the liquid droplets at the two outer corners 54*c* and 55*c* so that the liquid droplets move toward and fall into the mist flow pipe 37.

Thus, liquid droplets easily fall into the mist flow pipe 37. This minimizes the amount of liquid at the tube 51 and avoids an oversaturated state.

Condensation on the inner surface of a mist nozzle is held by surface tension at the corners. This limits the flow of condensation from the corner of the step toward the exit. Further, when a certain amount of condensation collects at a step, gravitational force acts on the condensation. Consequently, the condensation falls toward the entrance. This avoids an oversaturated state caused by condensation, and continuously holds the condensations at the step.

The present embodiment has the advantages described below.

(1) The liquid droplets 60 formed on the inner surface 51*a* in the tube 51 of the mist nozzle 50 are held on the steps 54*a* and 55*a* of the inner constrictions 54 and 55. This limits the flow of the liquid droplets 60 from the steps 54*a* and 55*a* of the constrictions 54 and 55 toward the mist exit 53. Further, when a certain amount of condensation collects at the steps 54*a* and 55*a*, the condensation falls and returns toward the mist entrance 52.

This avoids oversaturation. Even when condensation occurs, the collection of liquid droplets at the mist exit 53 is limited. Thus, the mist release (released mist amount, released mist velocity, and released mist direction) is further stabilized. This allows for warm mist to be uniformly delivered to the face of the user. The uniform temperature rise of the face and moisturizing of the face has a stable beauty effect on the face.

(2) The step formed by the inner constriction 54 has a height H1 (length) that is less than the length L1 of the inner nozzle surface 51*b* at the upstream side of the inner constriction 54 in the axial direction. Further, the step formed by the inner constriction 55 has a height H2 (length) that is less than the length L2 of the inner nozzle surface 51*c* at the upstream side of the inner constriction 55 in the axial direction. Thus, liquid droplets held by surface tension at the inner corners 54*b* and 55*b* grow in the radial direction rather than the axial direction. Further, even when a certain amount of liquid droplets collect, the liquid droplets spread in the axial direction.

As a result, liquid droplets fall toward the entrance 52 due to gravitational force before the liquid droplets move beyond the steps 54*a* and 55*a* that are closer to the exit 53. This avoids oversaturation. Even when condensation occurs, the entrance of liquid droplets into the minimum diameter portion 58 is limited, and warm mist may be stably released.

(3) The outer constrictions 56 and 57 are arranged on the outer surface 51*d* of the mist nozzle 50. Thus, liquid droplets condensed at the outer side of the mist nozzle 50 grow to a size causing the liquid droplets to fall.

This limits the entrance of, for example, small liquid droplets into the mist nozzle 50 from the mist entrance 52. Thus, the liquid droplets that flow through the mist nozzle 50 toward the mist exit are limited. This further stabilizes the release of the warm mist.

(4) The inner corners 54*b* and 55*b* on the steps 54*a* and 55*a* of the inner constrictions 54 and 55 are rounded. Thus, tension force is not easily generated at the inner corners 54*b* and 55*b*. As a result, even when liquid droplets grow on the corners 54*c* and 55*c*, the liquid droplets easily move beyond the inner corners 54*b* and 55*b* and enter the entrance 52.

As a result, liquid droplets fall toward the entrance 52 due to gravitational force before the liquid droplets move beyond the steps 54*a* and 55*a* that are closer to the exit 53. This allows for condensation to be continuously held without causing oversaturation. Thus, the entrance of liquid droplets into the minimum diameter portion 58 is limited, and warm mist may be further stably released.

(5) The corner 52*a*, which is closer to the mist entrance 52 (upstream) than the inner constrictions 54 and 55 is rounded so that surface tension is limited at the corner 52*a*. Thus, even when the liquid droplets grow held by surface tension at the corner 52*a*, the liquid droplets easily flow toward the mist entrance 52. Accordingly, the release of mist is further stabilized.

It should be apparent to those skilled in the art that the present invention may be embodied in many other specific forms without departing from the spirit or scope of the invention. Particularly, it should be understood that the present invention may be embodied in the following forms.

In the above embodiment, the heater HT generates warm mist. Instead, cold mist may be generated through ultrasonic oscillation.

In the above embodiment, the mist generator device is embodied in a cosmetic device 1. However, the mist generator device may be embodied in another device such as a humidifier.

In the above embodiment, water serves as liquid. The water may contain alkali components, acid components, cosmetic components, carbonic components, and the like.

In the above embodiment, the inner surface of the tube 51 may be smoothened by performing chemical polishing and an antirust treatment. Further, an oxide coating or plating may be applied to the inner surface of the tube 51 to limit wear.

Figure 10:
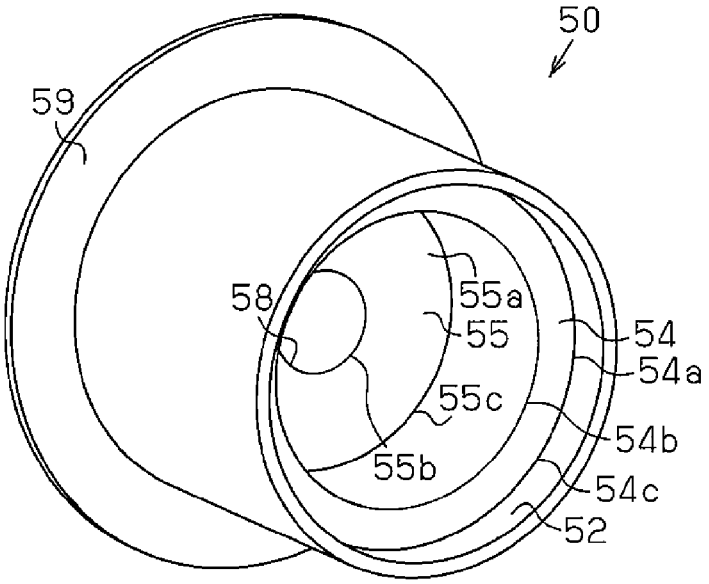
FIG. 10 is a perspective view showing another embodiment of the mist nozzle.
Figure 11:
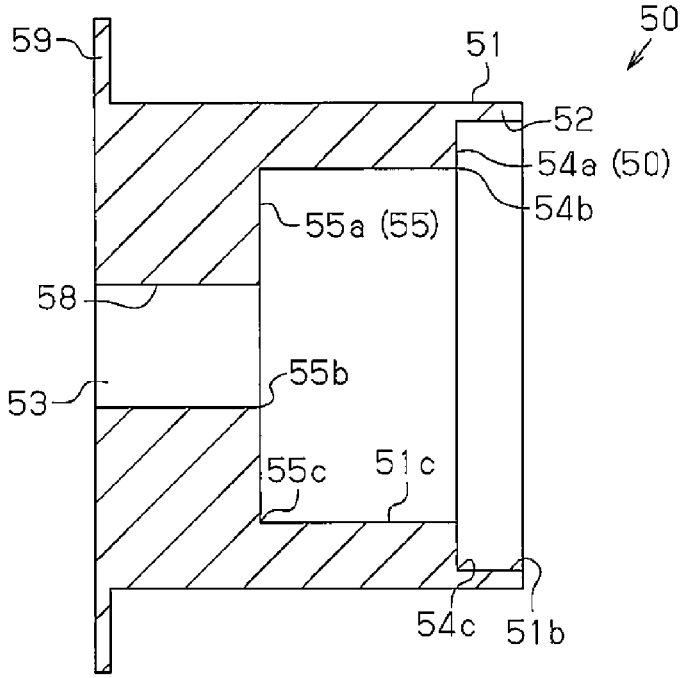
FIG. 11 is a sectional view showing a further embodiment of the mist nozzle.
Figure 12:
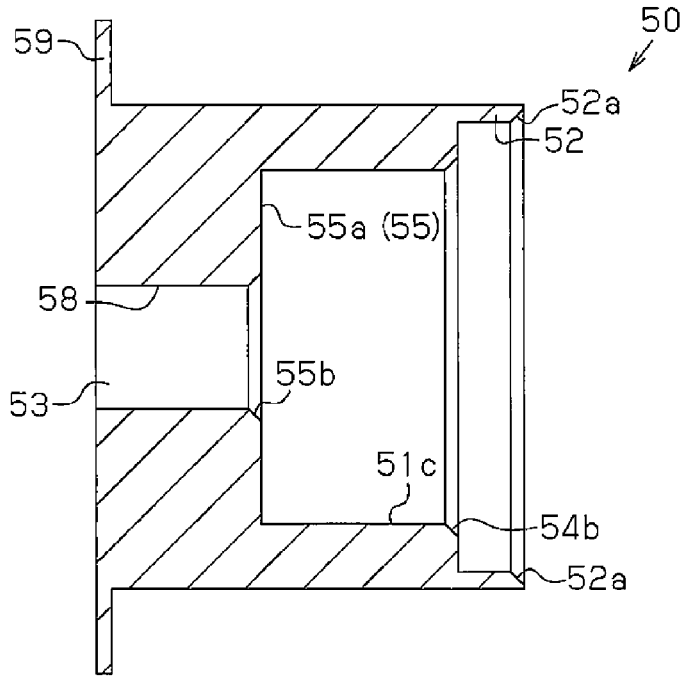
FIG. 12 is a sectional view showing yet another embodiment of the mist nozzle.

In the above embodiment, the inner corners 54*b* and 55*b* are rounded. Instead, the inner corners 54*b* and 55*b* may be chamfered as shown in FIG. 12 or be unprocessed as shown in FIGS. 10 and 11. In the same manner, the mist entrance 52 may be chamfered or unprocessed.

In the above embodiment, as shown in FIGS. 10 and 11, outer constrictions may be omitted.

The mist generator device according to the present invention is used as a cosmetic device that atomizes liquid into a mist, sprays the mist toward the user, and applies moisture to the skin of the user to produce a beauty effect. The mist generator device allows for mist to be stably discharged and thus may be applied to a health device, which changes the discharge amount of mist or the location sprayed with the mist for health purposes, or to a humidifier or air conditioner that sprays mist into the air.

The present examples and embodiments are to be considered as illustrative and not restrictive, and the invention is not to be limited to the details given herein, but may be modified within the scope and equivalence of the appended claims.

The invention claimed is:

1. A mist generator device comprising:

a mist generation unit that generates mist from a liquid;

a mist flow passage connected to the mist generation unit, wherein the mist from the mist generation unit flows through the mist flow passage; and a tubular mist nozzle that releases the mist, which is supplied from the mist generation unit through the mist flow passage, out of the mist generator device, wherein the mist nozzle includes:

a mist entrance, a mist exit, and at least one inner constriction located at an inner side of the mist nozzle, wherein the at least one inner constriction includes a step that decreases an inner diameter of the mist nozzle from the mist entrance toward the mist exit, wherein the mist releasing direction is inclined upward by a predetermined angle from a reference plane that is parallel to a plane on which the mist generator device is set, the mist generator device further comprising:

a high-voltage discharge device that performs a high-voltage discharge to ionize the mist, the mist nozzle is located directly above the high-voltage discharge device.

2. The mist generator device according to claim 1, wherein the mist nozzle includes:

a first inner surface located closer to the mist entrance than the step of the at least one inner constriction, and a second inner surface located closer to the mist exit than the step of the at least one inner constriction; and the first inner surface is shorter in an axial direction of the mist nozzle than the second inner surface.

3. The mist generator device according to claim 1, wherein the mist nozzle includes at least one outer constriction located at an outer side of the mist nozzle, wherein the at least one outer constriction includes a step that decrease an outer diameter of the mist nozzle from the mist entrance to the mist exit.

4. The mist generator device according to claim 1, wherein the at least one inner constriction includes an inner corner located at an inner end of the step in a radial direction of the mist nozzle, and the inner corner is rounded or chamfered.

5. The mist generator device according to claim 1, wherein the mist entrance includes a rounded or chamfered corner.

* * * * *